US005783141A

United States Patent [19]

Patel et al.

[11] Patent Number: 5,783,141

[45] Date of Patent: Jul. 21, 1998

[54] ANNULAR FURNACE

[75] Inventors: Sushil N. Patel, Lancaster; Frederick C. Wong, Williamsville, both of N.Y.

[73] Assignee: The Research Foundation of State University of New York at Buffalo, Amherst, N.Y.

[21] Appl. No.: 511,347

[22] Filed: Aug. 4, 1995

[51] Int. Cl.[6] ..... C21D 11/00

[52] U.S. Cl. ..... 266/87; 266/252

[58] Field of Search ..... 266/249, 252, 266/255, 256, 87; 432/138

[56] References Cited

U.S. PATENT DOCUMENTS

| | | | |
|---|---|---|---|
| 3,138,372 | 6/1964 | Beck | 266/255 |
| 4,449,924 | 5/1984 | Ceretti | 432/138 |
| 4,496,312 | 1/1985 | Yamada et al. | 266/249 |
| 4,497,674 | 2/1985 | Ikegami et al. | 148/156 |
| 4,502,671 | 3/1985 | Omura | 266/256 |
| 4,763,880 | 8/1988 | Smith et al. | 266/252 |
| 4,812,608 | 3/1989 | Alexandrov et al. | 219/10.75 |
| 4,817,920 | 4/1989 | Erfort, Jr. | 266/252 |
| 5,019,689 | 5/1991 | Bollier et al. | 432/138 |

OTHER PUBLICATIONS

Haugen, et al., "Recent Status on High Temperature Superconducting Bi2Sr2CaCu208+X Wire Development at NYSIS," Journal of Electronic Materials, (Aug. 1995).

*Primary Examiner*—Scott Kastler

*Attorney, Agent, or Firm*—Seed and Berry LLP; Kathleen R. Terry; Robert E. Mates

[57] ABSTRACT

An annular furnace capable of delivering precise temperature control. The furnace may also take the form of a toroid. The furnace may be employed in the heat treatment of many types of material including superconducting tape.

18 Claims, 6 Drawing Sheets

ANNULAR FURNACE

BACKGROUND OF THE INVENTION

1. Field of the Invention

The present invention relates to a novel annular furnace for the heat treatment of material having the geometry of wire or tape or ribbon or strip.

2. Description of the Related Art

Many kinds of material in the shape of wire or tape or ribbon or strip benefit from heat treatment processes. The quality of such material can depend entirely upon the temperature control capability in furnaces employed to carry out such processes. For example, recent research in the area of superconducting materials has focused on the production of commercially viable lengths of superconducting wire or tape. High quality superconducting tapes have been fabricated in relatively short lengths, typically less than 10 meters. Such tape is made in several well known steps. A powdered metal oxide typically comprising bismuth, strontium, calcium, and copper, called a precursor powder, is packed into a silver tube. The tube is mechanically drawn into the shape of a wire and then cold rolled into a tape. The tape at this stage is identified as green tape and is not superconducting. Green tape is co-wound with a teflon tape or other inert separating material to form a pancake coil which is annealed in a furnace at low temperatures, typically 100 to 200 degrees Celsius, for 1 to 3 hours. This initial heat treatment relieves stress built up in the silver sheathed tape. The teflon is then removed leaving a freestanding tape which is annealed at high temperatures, generally between 850 and 900 degrees Celsius, according to a predetermined schedule. This second annealing step makes the tape superconducting at cryogenic temperatures. Any inert separating material which can withstand the above-mentioned annealing temperatures without fusing or otherwise interfering with the green tape may be left co-wound with the green tape for use during the annealing process.

The quality of the tape (or wire) as a superconductor is highly sensitive to the second high temperature heat treatment schedule. The period of time at which the tape is held at a maximum annealing temperature is particularly critical. Furnace temperature must be controlled to within ±1.0 degrees Celsius over the entire annealing schedule. This sensitivity to time and temperature also requires the entire length of tape to be heated and cooled uniformly.

Precise control of the temperature of the superconducting tape (or wire) during the annealing process requires the temperature profile in the annealing furnace to be uniform over the volume enclosing the tape. In larger conventional box furnaces such uniform temperature profiles are difficult to achieve and may exist in only a small fraction of the total volume of the heated furnace chamber. Convection currents arise inside larger heated box furnace chambers due to cooling along the sides of the furnace. These convection currents disrupt temperature profiles inside the chamber leaving only a centrally located volume at a relatively constant temperature.

Conventional box furnaces are sufficient for annealing short lengths of superconducting tape or wire as the short lengths may be positioned in the central portion of a box furnace chamber where the temperature is stable. Commercially viable tapes are on the order of 1000 meters or more in length, however, and require much larger box furnaces than those now in use. In a box furnace of sufficient size to accommodate a long superconducting tape the convection currents would be of such magnitude that the maintenance of a sufficient interior volume at a steady and uniform temperature would be extremely difficult if not impossible.

Alexandrov et al. disclose an annular oven in U.S. Pat. No. 4,812,608. The cross-sectional geometry of the interior chamber is very large relative to the radius of the oven which renders it incapable of providing highly precise temperature control over a large interior chamber volume. Ikegami et al. disclose an annealing furnace with an annular shape in U.S. Pat. No. 4,497,674. The furnace has a plurality of apertures to accommodate the continuous processing of steel strip. The movement of steel strip through the interior volume and the existence of multiple apertures in the chamber significantly disrupt the temperature profile inside the furnace by aiding and enhancing convection currents. Such a furnace is not capable of maintaining highly precise temperature control.

SUMMARY OF THE INVENTION

The object of this invention is to provide a furnace configuration which is relatively large and capable of producing a uniform temperature profile over a significant portion of the heated furnace chamber. The invention is a furnace with an annular heated chamber. The diameter of the annulus is relatively large which allows for a large total volume, while the chamber cross section is relatively short and narrow which serves to supress convection currents which disturb the temperature profile inside the chamber. Another advantage of the annular chamber is that the furnace length turns back upon itself eliminating two end surfaces which would otherwise contribute to heat loss and convection currents. The annular furnace chamber geometry also has minimal thermal mass which reduces energy consumption significantly and enables much faster heating and cooling of the chamber. The furnace geometry allows a more uniform and controlled temperature-time profile than is possible in box-type furnaces.

The shape of the annular chamber is advantageously adapted to accommodate very long, thin material such as long pieces of superconducting tape which may be wound in the shape of the annulus. The annular shape also allows for the winding and unwinding of tape with minimal internal stress. In a box type furnace the tape is necessarily wound into a very compact shape creating internal stress which reduces the quality of the resulting superconductor. The annular furnace configuration is advantageously shaped to accommodate other material of a similar form such as ribbon or strip or wire which may require precise heat treatment. The cross-sectional shape of the furnace chamber need not be the rectangle of an annulus but may be any closed contour, including the curved cross-section of a toroid.

DESCRIPTION OF THE PREFERRED EMBODIMENT

Figure 1:
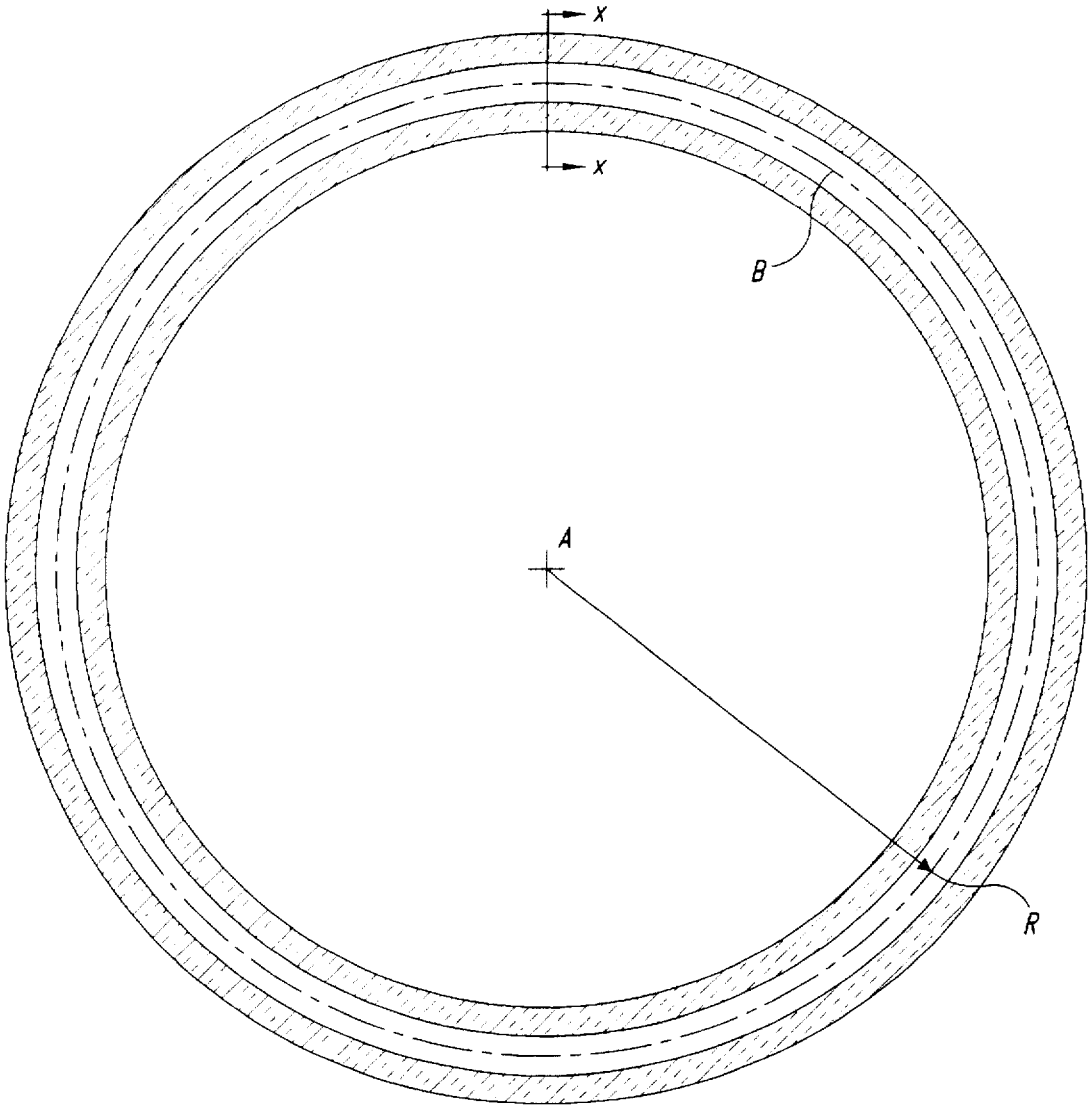
FIG. 1 illustrates a sectional top view of the annular furnace chamber.
Figure 2:
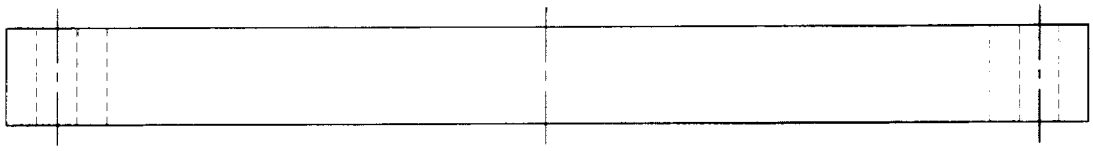
FIG. 2 illustrates a front view of the annular furnace.

FIGS. 1 to 4 illustrate an annular furnace according to the invention. The geometry of the heated furnace chamber is defined by three dimensions: a mean radius R, a height H, and a width W. The mean radius dimension R, shown in FIG. 1, is measured from a central vertical axis A to a horizontal, circular centerline B running through the geometric center of the furnace chamber. The H and W dimensions shown in FIG. 4 define the cross-sectional shape of the furnace chamber. The furnace chamber is comprised of four walls: a bottom wall 10, a top wall 11, an inner wall 8, and an outer wall 9. The H dimension defines the distance between bottom wall 10 and top wall 11. The W dimension defines the distance between heating panels 20 which are fixed to inner wall 8 and outer wall 9, respectively. According to a preferred embodiment of the invention, the mean radius of the chamber R is 61 inches (155 cm), the width W is 5.25 inches (13.34 cm), and the height H is 3.8125 inches (9.68 cm).

The four walls of the furnace chamber completely enclose and insulate the chamber from ambient conditions. The geometry of the furnace chamber must be completely enclosed without aperture or any other type of opening in order to supress heat loss and enable the maintenance of a uniform temperature profile. Inner wall 8 is circular in shape having a radius smaller than the mean radius R. Outer wall 9 is circular in shape having a radius larger than the mean radius R. The top and bottom walls have identical annular shapes. Each wall is comprised of an inner surface, a thermally insulating material, and an outer shell. The thermally insulating material, shown by hatch-lines in FIGS. 1, 3, and 4, may be a fiberglass based material or any other material with superior thermal insulation properties. Ceramic cloth is placed along the bottom wall to further insulate the chamber. The outer shell material may be sheet steel or any other rigid material which supplies structural support for the chamber. The furnace itself may be supported above a floor by any conventional support means attached to the outer shell. Top wall 11 is constructed in sections around the circumference of the furnace, each section being individually removeable to provide access to the furnace chamber. Access to the chamber is necessary to load or unload material or to service the chamber region. A plurality of handles 12 are attached to each top wall section to facilitate access to the furnace interior. The above described furnace geometry advantageously encloses a large volume inside only four insulated surfaces. Two end walls have been eliminated by virtue of the fact that the annular shape turns back upon itself. This feature avoids heat loss and convection currents which are associated with the end walls of a conventional furnace.

Figure 3:
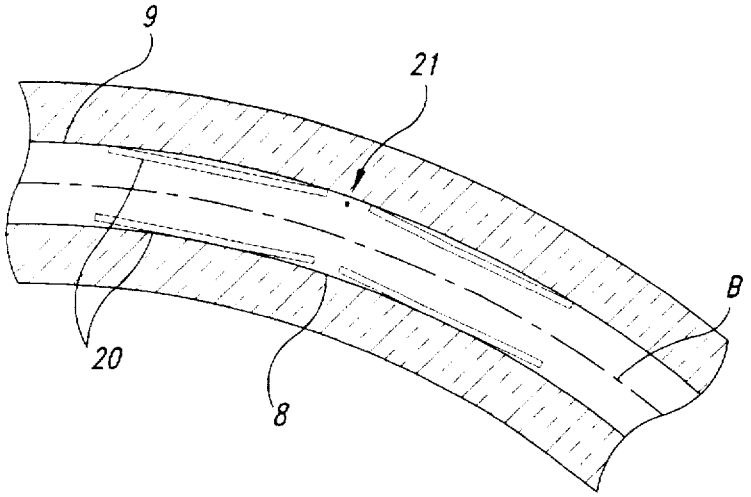
FIG. 3 illustrates a sectional top view of two heating zones in the annular furnace chamber.
Figure 4:
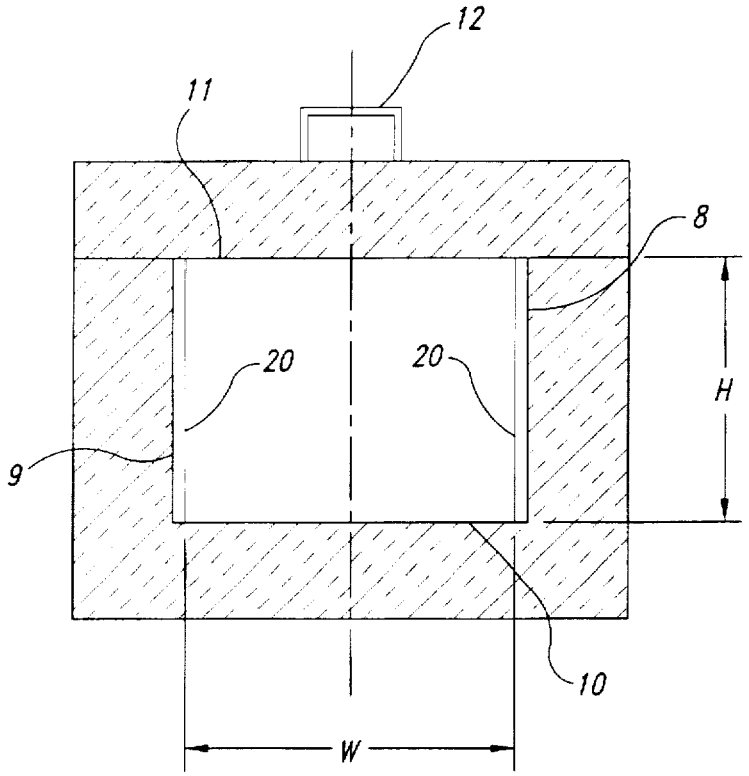
FIG. 4 illustrates a view according to line X—X of the cross-sectional shape of the annular furnace chamber.
Figure 7:
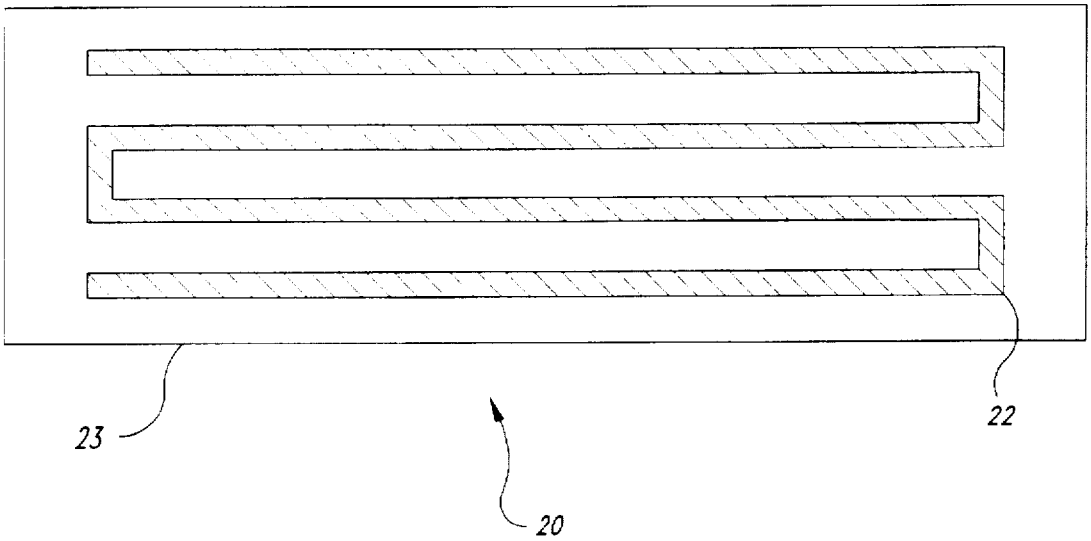
FIG. 7 illustrates a front view of a heating panel.
Figure 8:
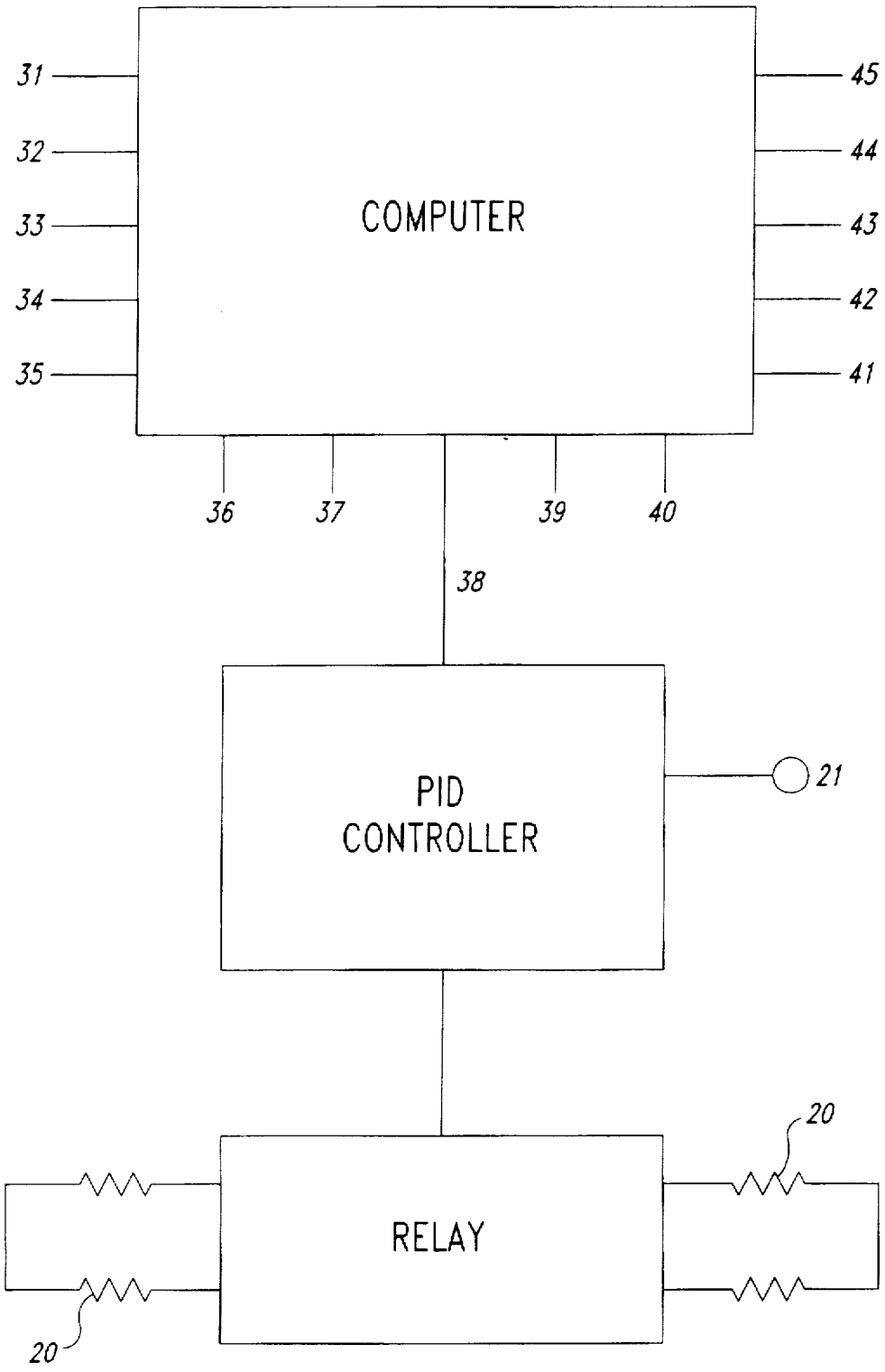
FIG. 8 is a schematic illustration of the temperature control system.

A plurality of heating panels 20 are disposed along the inner surfaces of both the inner wall 8 and the outer wall 9. The heating panels are grouped in pairs, each pair comprising two panels facing each other across the width W of the furnace chamber as shown in FIG. 3. Each panel, shown in FIG. 7, is comprised of an electric resistance heating element 22 wound in a horizontal pattern across a ceramic heat resistant plate 23 which is fixed to an inner surface of the inner or outer wall. Each pair of panels delimits a heating zone between them, and the length of the furnace chamber is divided into 30 such heating zones. The two electric resistance heating elements in each pair of panels are connected in series such that power is delivered to each pair of elements in series. This arrangement is illustrated in FIG. 8.

Fifteen temperature sensing thermocouples 21 are fixed along the length of the furnace chamber near the outer wall such that they do not interfere with the placement of superconducting tape. Each thermocouple is employed to sense the temperature in two heating zones as shown in FIG. 3 and deliver a signal to a temperature control system. A schematic of the temperature control system is shown in FIG. 8. A computer generates digital signals representing the desired chamber temperature according to a time-temperature profile. Identical digital signals are sent to fifteen controllers, numbered 31–45, each of which controls the temperature of two heating zones. The controllers are identical Proportional Integral Differential (PID) controllers. The control hardware for a pair of heating zones is detailed in FIG. 8. Each PID controller receives a digital command signal from the computer and a feedback signal from a temperature sensor 21. The controller generates a signal corresponding to the power to be delivered to the heating elements which is sent to a relay. The relay in turn delivers power to the heating elements 22 of two pairs of panels 20, each pair connected in series. The above described feedback control system provides localized control of the temperature of the furnace chamber within desired tolerances. It will be apparent to one of skill in the art that other conventional control system configurations may accomplish the same end. For example, the number of temperature controllers and thermocouples may be doubled such that the temperature of each heating zone is controlled by a single controller in a feedback manner.

Figure 5:
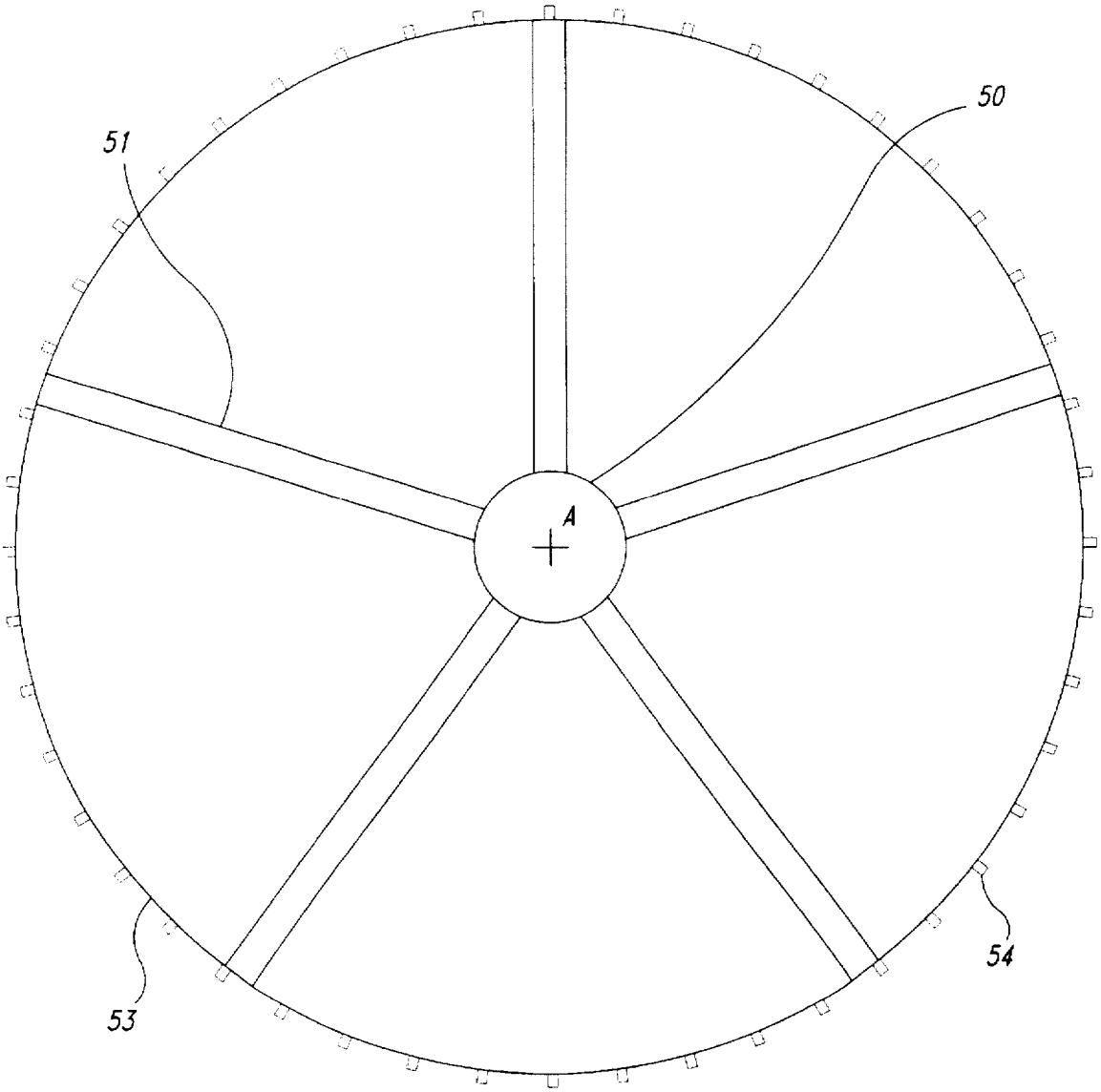
FIG. 5 illustrates a top view of the web support and frame.
Figure 6:
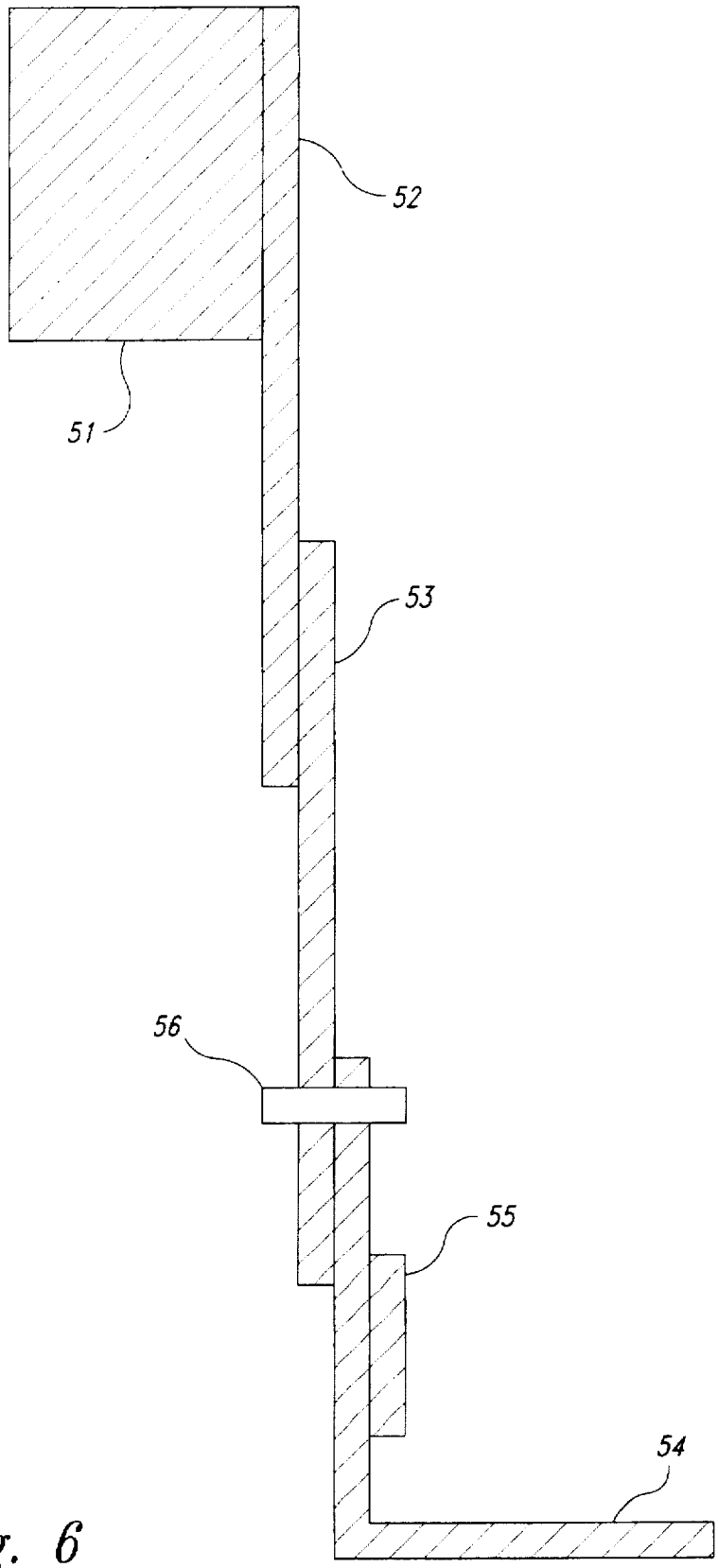
FIG. 6 illustrates a cross-sectional view of the web support along the centerline of one of the spokes.

FIGS. 5 and 6 illustrate a web support which supports a long superconducting tape as it sits inside the furnace chamber. The web support is removably attachable to a frame comprised of a core 50 which is fixedly attached to rotatable machinery and rotates about axis A of the annulus. A plurality of spokes 51 are fixedly attached to said core and extend outward in a radial direction, each terminating with a distal end portion. A downwardly extending support bar 52 is fixed to the distal end of each spoke. A circular rim 53 is fixedly attached to the support bars. Circular rim 53 is comprised of an integral loop of sheet metal the width of which is maintained in a vertical orientation. The web support supports the windings of superconducting tape as they sit inside the furnace chamber during the annealing process, and provides the structure around which the tape is wound. The web support is comprised of a series of L-shaped tabs 54 which extend downward and outward in a radial direction. Tabs 54 are connected by a circular band 55 to which each tab is fixedly attached along its vertical portion. A plurality of the tabs include holes near the top edge which correspond to holes in circular rim 53. The web support is bolted to the circular rim through these holes with bolts 56. Green tape is wound around the web support as it is rotated by the frame which is in turn rotated by said rotatable machinery. After a sufficient length has been wound the frame is lowered into the uncovered furnace chamber such that the web support rests on heat resistant ceramic blocks placed along the bottom wall 10 of the chamber. The web support 54, 55 is then detached from the frame by the removal of bolts 56, and the frame is lifted out of the furnace chamber. The web support sits within the chamber maintaining the entire length of superconducting tape in a region of constant temperature.

According to a preferred embodiment of the invention the web support is comprised of "INCONEL"® (Inco Alloys International, Inc., Huntington, W. Va.), a material which maintains its structural integrity at temperatures up to 1000 degrees Celsius. Those skilled in the art will recognize other materials capable of supporting the tape inside the furnace while maintaining structural integrity at very high temperatures. For example, the web support may be comprised of high temperature stainless steel or "HASTELLOY"® (Haynes International, Kokomo, Ind.), or the tape may be supported by a ceramic material.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

For example, the circumferential shape of the furnace may be any closed contour which is not a circle but which, nevertheless, turns back upon itself to form a chamber with only four sides: a bottom, a top, an inner side, and an outer side. Such a furnace geometry may be characterized by a mean radius which is an average of the distance from a vertical centerline A to a centerline B of the chamber as in FIG. 1. The cross-sectional shape of the chamber may also be any closed contour other than the rectangle which defines an annulus. Any curved or rounded contour which defines a closed surface may constitute the cross section of a furnace chamber according to the invention. Such a chamber would have the shape of a toroid defined by a mean radius R, an average or mean height H and an average or mean width W. The mean radius would be measured from a central vertical axis A to a horizontal, circular centerline B representing the average distance between the geometric center of the furnace chamber and the vertical axis. The H and W dimensions would define the height and width of the cross-sectional shape of the toroid. The heating elements may be arranged in many ways well known to those skilled in the art. For example, the elements themselves may arranged in any orientation along the face of a ceramic plate. The heating elements may be arranged in any fashion along the interior chamber of the furnace, including along only one side wall, the bottom wall, the top wall, or any combination thereof.

What is claimed is:

1. A furnace comprising:

a furnace wall defining an interior chamber having the geometry of an enclosed annulus defined by a mean radius dimension, a height dimension, and a width dimension;

one or more heating elements disposed on the furnace wall inside said interior chamber;

wherein the magnitude of said mean radius dimension is greater than 10 centimeters; and wherein the magnitude of said height dimension is greater than 1 millimeter and less than one half the magnitude of said mean radius dimension.

2. A furnace comprising:

a furnace wall defining an interior chamber having the geometry of an enclosed annulus defined by a mean radius dimension, a height dimension, and a width dimension;

one or more heating elements disposed on the furnace wall inside said interior chamber;

wherein the magnitude of said mean radius dimension is greater than 10 centimeters; and wherein the magnitude of said width dimension is greater than 1 millimeter and less than one half the magnitude of said mean radius dimension.

3. A furnace according to claim 2 wherein the magnitude of said height dimension is greater than 1 millimeter and less than one half the magnitude of said mean radius dimension.

4. A furnace comprising:

a furnace wall defining an interior chamber having the geometry of an enclosed toroid defined by a mean radius dimension, a mean height dimension, and a mean width dimension;

one or more heating elements disposed on the furnace wall inside said interior chamber;

wherein the magnitude of said mean radius dimension is greater than 10 centimeters; and wherein the magnitude of said mean height dimension is greater than 1 millimeter and less than one half the magnitude of said mean radius dimension.

5. A furnace comprising:

a furnace wall defining an interior chamber having the geometry of an enclosed toroid defined by a mean radius dimension, a mean height dimension, and a mean width dimension;

one or more heating elements disposed on the furnace wall inside said interior chamber;

wherein the magnitude of said mean radius dimension is greater than 10 centimeters; and wherein the magnitude of said mean width dimension is greater than 1 millimeter and less than one half the magnitude of said mean radius dimension.

6. A furnace according to claim 5 wherein the magnitude of said mean height dimension is greater than 1 millimeter and less than one half the magnitude of said mean radius dimension.

7. A furnace as in any one of claims 1–6, further comprising:

a plurality of temperature sensors disposed on the furnace wall inside said interior chamber;

a feedback control system receiving command signals from a computer and feedback signals from said temperature sensors;

wherein said feedback control system is structured to provide power to said heating elements based on said command signals and said feedback signals; and wherein said feedback control system is structured to control a temperature of said interior chamber.

8. A furnace for the heat treatment of superconducting material, comprising:

a furnace wall defining an interior chamber having the geometry of an enclosed annulus defined by a mean radius dimension, a height dimension, and a width dimension;

one or more heating elements disposed on the furnace wall inside said interior chamber, wherein the magnitude of said mean radius dimension is greater than 10 centimeters;

wherein the magnitude of said width dimension is greater than 1 millimeter and less than one half the magnitude of said mean radius dimension; and wherein the magnitude of said height dimension is greater than 1 millimeter and less than one half the magnitude of said mean radius dimension.

9. A furnace for the heat treatment of superconducting material, comprising:

a furnace wall defining an interior chamber having the geometry of an enclosed toroid defined by a mean radius dimension, a mean height dimension, and a mean width dimension;

one or more heating elements disposed on the furnace wall inside said interior chamber;

wherein the magnitude of said mean radius dimension is greater than 10 centimeters;

wherein the magnitude of said mean width dimension is greater than 1 millimeter and less than one half the magnitude of said mean radius dimension; and wherein the magnitude of said mean height dimension is greater than 1 millimeter and less than one half the magnitude of said mean radius dimension.

10. A furnace according to claim 8, further comprising:

a plurality of temperature sensors disposed on the furnace wall inside said interior chamber;

superconducting material support means;

a feedback control system receiving command signals from a computer and feedback signals from said temperature sensors;

wherein said feedback control system is structured to provide power to said heating elements based on said command signals and said feedback signals; and wherein said feedback control system is structured to control a temperature of said interior chamber.

11. A furnace according to claim 9, further comprising:

a plurality of temperature sensors disposed on the furnace wall inside said interior chamber;

superconducting material support means;

a feedback control system receiving command signals from a computer and feedback signals from said temperature sensors;

wherein said feedback control system is structured to provide power to said heating elements based on said command signals and said feedback signals; and wherein said feedback control system is structured to control a temperature of said interior chamber.

12. A furnace comprising:

an inner wall with a substantially circular cross section defined by a first radius dimension, the magnitude of said first radius dimension being greater than 10 centimeters;

an outer wall with a substantially circular cross section defined by a second radius dimension, said inner and outer walls being radially spaced apart by a mean width dimension;

a bottom wall and a top wall spaced apart by a mean height dimension such that said inner wall, said outer wall, said bottom wall, and said top wall define an enclosed annular interior chamber;

one or more heating elements disposed on one or more of the inner wall, the outer wall, the bottom wall, and the top wall inside the interior chamber; and wherein the magnitude of said mean width dimension is greater than 1 millimeter and less than one half the magnitude of said first radius dimension, and the magnitude of said mean height dimension is greater than 1 millimeter and less than one half the magnitude of said first radius dimension.

13. A furnace according to claim 12 where in said enclosed annular interior chamber has the geometry of an enclosed toroid.

14. A furnace according to claim 12 wherein said inner and outer walls are cylindrically shaped and concentrically arranged to provide said enclosed annular interior chamber with a cylindrical shape.

15. A furnace according to claim 12, further comprising:

a plurality of temperature sensors disposed along one of said walls of said furnace to sense a temperature in said annular interior chamber;

a feedback control system receiving command signals from a computer and feedback signals from said temperature sensors, said feedback control system being structured to provide power to said heating elements based on said command signals and said feedback signals to thereby control the temperature in said annular interior chamber; and wherein said heating elements are disposed along one or both of said inner and outer walls.

16. A furnace according to claim 15, further comprising:

at least fifteen temperature sensors disposed along one of said walls of said furnace; and wherein said heating elements comprise at least fifteen heating elements disposed along one or both of said inner and outer walls of said furnace such that each heating element is coupled to one of said temperature sensors in a feedback manner to control a temperature in a zone of said annular interior chamber.

17. A furnace according to claim 15 wherein said heating elements are fixed to said inner and outer walls and are structured to provide a substantially uniform temperature.

18. A furnace as in any one of claims 1–6 wherein the furnace wall is comprised of an inner wall, an outer wall, a bottom wall, and a top wall and the heating elements are disposed on the inner and outer walls inside said interior chamber, the interior chamber being heated by the heating elements to a substantially uniform temperature.

* * * * *